United States Patent [19]

Everitt

[11] 4,176,409

[45] Dec. 4, 1979

[54] KNIT CAP WITH MULTIPLE LAYER CONSTRUCTION AND PROCESS OF MAKING SAME

[75] Inventor: Allen D. Everitt, Milwaukee, Wis.

[73] Assignee: Allen D. Everitt Knitting Company, Milwaukee, Wis.

[21] Appl. No.: 816,035

[22] Filed: Jul. 15, 1977

[51] Int. Cl.[2] ..... A42B 1/04

[52] U.S. Cl. ..... 2/173; 2/202; 2/205; 2/201

[58] Field of Search ..... 2/173, 202, 204, 205, 2/206, 207, 171, 198, 201, 243 R, 243 B

[56] References Cited

U.S. PATENT DOCUMENTS

| | | | |
|---|---|---|---|
| 991,777 | 5/1911 | Goodman | 2/201 X |
| 3,531,952 | 10/1970 | Chesebro, Jr. | 2/202 X |
| 3,740,767 | 6/1973 | Schuessler | 2/173 |
| 3,747,124 | 7/1973 | Zientara | 2/173 X |

*Primary Examiner*—Werner H. Schroeder
*Assistant Examiner*—Moshe I. Cohen

[57] ABSTRACT

A continuous tubular piece is made in a continuous knit fashion. A limited area, located an equal distance from the two ends of the piece, is knit with a tighter stitch to provide a gathered area. Two similar tighter stitched, gathered areas are provided between the central gathered area and each of the ends of the piece. These two additional gathered areas on both sides of the central area are relatively spaced closer together than their spacing from the central area and the ends of the tubular piece. The tubular piece is folded back on itself using the central gathered area as a fold line, the two opposite ends being brought together. The two additional gathered areas, which were on opposite sides of the central area, are now together, one overlapping the other. A second fold is now made in the piece. The piece is folded back on itself a second time using a point midway between the two additional gathered areas as the fold line. This second fold line is a closed, smooth surface. In contrast, the opposite end of the now folded piece exposes various layers of the folded piece and that end is closed with a standard four-way closure to provide the crown for the finished cap. The gathered portion adjacent the open end of the cap provides a fold line for forming the cuff of a conventional hockey cap or openings are provided between that fold line and the closed crown of the cap to form a crusader hood with the gathered portion providing a tightly fitting area under the chin of the wearer.

5 Claims, 5 Drawing Figures

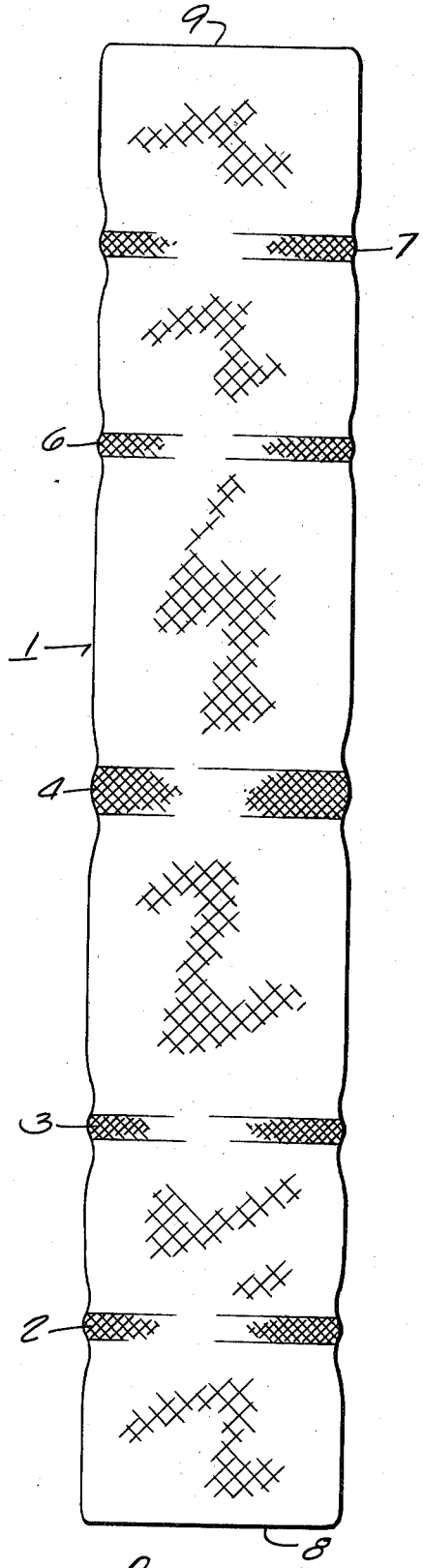
Fig. 1
Fig. 2
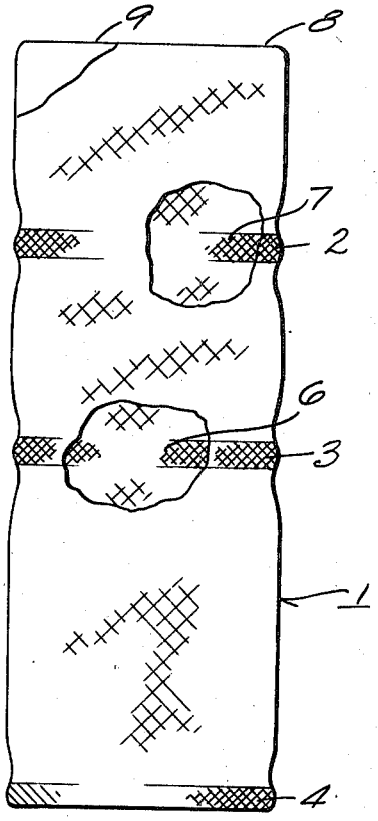
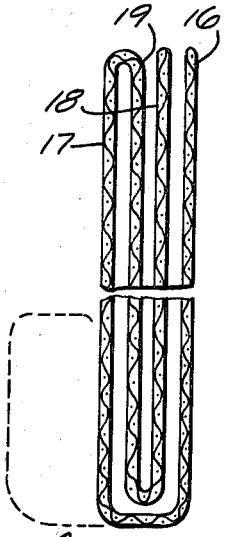
Fig. 4
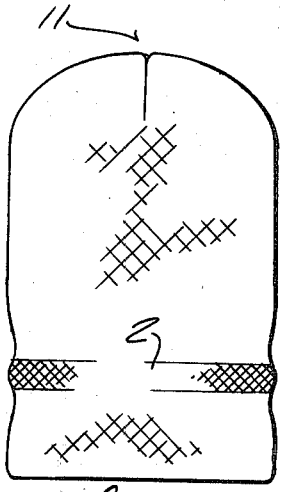
Fig. 3
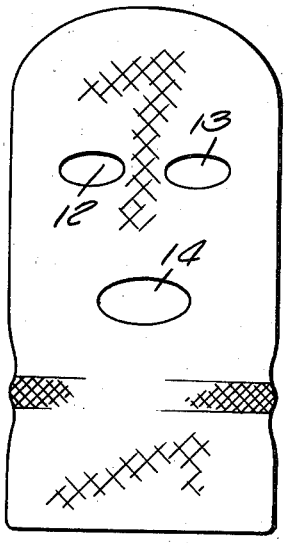
Fig. 5

KNIT CAP WITH MULTIPLE LAYER CONSTRUCTION AND PROCESS OF MAKING SAME

BACKGROUND OF THE INVENTION

This invention relates to knit caps and, more particularly, to a multiple layer cap made from a continuous knit tube.

Various knit cap constructions, and methods of making the knit caps, have been proposed in the past. U.S. Pat. Nos. 991,777, 2,998,611, and 3,531,952 are examples of knit caps made from a continuous knit tubular member.

Among the objects of this invention are to provide a knit cap construction which can be easily manufactured, provides improved thermal characteristics, exhibits a smooth, relatively non-bulky appearance even though having a multiple layer construction, and all in a basic cap construction which lends itself to the manufacture of more than one type of knit head covering.

SUMMARY OF THE INVENTION

For the achievement of these and other objects, this invention proposes a knit cap of multiple layer construction fashioned from a continuously knit basic tubular piece. The continuous tubular piece is knit with a conventional stitch but that basic stitch is interrupted periodically over the length of the piece to provide spaced areas characterized by having a tighter stitch to thereby provide a gathered knit area. One of the gathered areas is located equal distance between the opposite ends of the piece. One or more similar gathered areas are provided between the central gathered area and both ends of the piece.

The tubular piece so knit has a first fold back on itself utilizing the central area as the fold line. This brings the opposite ends of the piece together and also brings one of the additional gathered areas which was on one side of the central area into alignment with and overlapping the similar gathered area which had been on the opposite side of the central area.

On at least one side of the central area, two such additional gathered areas can be provided and these are located on the exterior of the folded piece after the first fold. A second fold is now made at a point midway between those two gathered areas, bringing the ends of the first folded piece together and positioning the two gathered areas in the outer layer together such that they are overlapping and spaced inwardly from one end of the piece. The overall piece has now been folded on itself twice. The end of the twice-folded piece adjacent the now overlapping additional gathered areas is relatively smooth since a continuous fold exists along that edge, the opposite end of the piece has the exposed layers of the original piece and also includes the central gathered area. That opposite end is closed with a conventional four-way closure and since the original gathered area is located in the closure, the bulk of the closure is thereby reduced.

The closed end of the tubular member provides a crown for a cap. The basic structure so provided can be used to form a conventional hockey cap by merely turning a cuff utilizing the gathered area adjacent the open end as the fold line. Alternatively, the final folded piece can be used to form a crusader hood by cutting the conventional crusader hood openings in the panels between the gathered area and the closed end and then utilizing the gathered area to provide tight engagement under the chin of the wearer of the crusader hood.

Other objects and advantages will be pointed out in, or be apparent from, the specification and claims, as will obvious modifications of the embodiments shown in the drawings, in which:

FIG. 1 is a view of the unfolded continuously knit piece;

FIG. 2 illustrates the piece after the first fold;

FIG. 3 illustrates the piece after the second fold and with the top closed;

FIG. 4 is a section view of the double fold piece; and

FIG. 5 is a view of an alternative cap arrangement.

DESCRIPTION OF THE PREFERRED EMBODIMENT

With particular reference to the drawings, a continuously knit tubular piece 1 is illustrated in FIG. 1. This piece is knit with a conventional rib knit stitch in a continuous fashion. At intervals along the tubular member, the number of stitches is varied so that a tighter stitched, gathered area is provided. These areas are 2, 3, 4, 6 and 7. One of the areas, 4, is located equal distance between the open ends 8 and 9 of the tubular piece. The pairs of areas 2, 3 and 4, 6 are located preferably equal distance between the central area and each of the open ends of the tubular piece. The gathered areas of the pairs, i.e., 2, 3 and 6, 7 are spaced relative to each other closer together than the pairs are spaced from their respective open end and the central area. The manner of knitting a continuous tube and providing the gathered areas in the appropriate locations utilizes generally conventional knitting techniques and will not be described in this application.

To form a basic cap structure, a first fold is made in the tubular piece as illustrated in FIG. 2. The central area provides the fold line and open ends 8 and 9 are brought together in registry. Similarly, due to indentical spacing between the pairs of gathered areas and with respect to the central area, the gathered areas which had been on opposite sides of the central area are now brought into overlapping relationship one pair registering with the other.

A second fold is now made in the already folded tubular piece. In this fold a point midway between the pairs of gathered areas 2, 3 and 6, 7 is used as the fold line. This brings all of the gathered areas 2, 3, 6 and 7 into registry and, moreover, places the original central gathered area at one end of the double-folded piece spaced furthest from those gathered areas.

The end of the twice-folded piece adjacent the gathered areas is generally smooth having one of the exterior folds over all of the interior layers. The opposite end exposes those of the layers which are open and it is that opposite end which is closed to provide the crown of the finished cap.

The closure is made with a conventional four-way closure 11 which is illustrated in FIG. 3. At this point, it will be noted that the basic cap now consists of four layers of fabric for optimum thermal characteristics. Moreover, because of the manner of folding the original central area, which had provided the initial fold line and which exhibits less bulkiness than the non-gathered areas, is located in the crown thereby minimizing the bulkiness of the closure area.

Structurally, the folded cap has a pair of outer layers 16, 17 and a pair of inner layers 18, 19, inner and outer being used in the context of the folded piece. In the finished cap outer layer 16 provides the inner panel of the cap and outer layer 17 provides the outer panel of the cap.

The basic folded structure illustrated in FIG. 3, having a closed crown portion and an open end provides a versatile, basic construction which can be used to provide, for example, two conventional types of caps.

A conventional hockey cap can be provided by folding a cuff utilizing the aligned gathered areas as the fold line, see dotted line showing in FIG. 4. Similarly, a crusader cap can be provided by cutting the customary crusader cap openings 12, 13, and 14 in the panels between the gathered areas and the closed crown and utilizing the overlapping gathered areas to provide a tight fit around the wearer's neck (see FIG. 5). In providing the crusader hood attention need only be given to providing slightly more panel length between the gathered areas 2, 3 and 6, 7, the central area and the open ends 8 and 9.

In the basic structure, the gathered areas are spaced along the length of the continuous piece and extend around the circumference of the cap. These gathered areas locate the various lines along which the piece is folded to provide the finished cap. Moreover, the gathered areas in the finished cap are located such that they reduce the bulkiness of the cap and tend to assist the cap in achieving its final shape.

Although this invention has been illustrated and described in connection with particular embodiments thereof, it will be apparent to those skilled in the art that various changes and modifications may be made therein without departing from the spirit of the invention or from the scope of the appended claims.

I claim:

1. In a multi-layer knitted cap formed of a knitted tubular piece having an initial unfolded length and initial opposite open ends, the tubular piece also including a first tightly knitted gathered area equally spaced between the initial opposite open ends, the improvement comprising:

a second tightly knitted gathered area located between the first tightly knitted area and one of the initial opposite ends, said second tightly knitted area being located nearer to the first tightly knitted area than to the one initial opposite end;

a third tightly knitted gathered area located between the first tightly knitted area and the other one of the initial opposite ends, said third tightly knitted area being symmetrically and oppositely located with said second tightly knitted area relative to the first tightly knitted area;

a first fold line defined by the first tightly knitted area and along which the entirety of the initial unfolded length is folded upon itself, thereby defining a once-folded length of the tubular piece in which said second and third tightly knitted areas are located in general registry with each other and the initial opposite ends are also located in general registry with each other;

a second fold line located between the registry of the initial opposite ends and the registry of said second and third tightly knitted areas and along which the entirety of the once-folded length is folded upon itself, thereby defining a twice-folded length of the tubular piece in which said second and third tightly knitted areas are still located in general registry with each other;

a closed end defined by the initial opposite ends and said first fold line joined in general registry therein;

an open end spaced from said closed end and peripherally bounded by said second fold line;

first and second inner layers folded on themselves about said second fold line;

first and second outer layers folded on themselves and on said first and second inner layers with said first outer layer forming the outside surface of said cap and said second outer layer forming the inside surface of said cap; and whereby said second tightly knitted area extends circumferentially about said first outer layer and said third tightly knitted area extends circumferentially about said second outer layer and in general registry with said second tightly knitted area.

2. The improvement according to claim 1 and further including a fourth tightly knitted gathered area adjacently spaced from said second tightly knitted area intermediate said second tightly knitted area and the one initial opposite end, a fifth tightly knitted gathered area adjacently spaced from said third tightly knitted area intermediate said third tightly knitted area and the other initial opposite end and being symmetrically and oppositely located with said fourth tightly knitted area relative to the first tightly knitted area;

wherein, when said cap is in said once folded length, said fourth and said fifth tightly knitted areas are located in general registry with each other;

wherein said second fold line is located between the registry of said second and third tightly knitted areas and the registry of said fourth and fifth tightly knitted areas; and whereby said fourth tightly knitted area extends circumferentially about said first inner layer, said fifth tightly knitted area extends circumferentially about said second inner layer, and said second, third, fourth, and fifth tightly knitted areas are in general registry with each other.

3. The improvement according to claim 1 wherein the portion of said cap between the registry of said second and third tightly knitted areas and said open end is folded upwardly toward said closed end using the registry of the second and third tightly knitted areas as a fold line, whereby a cuff is provided around said open end.

4. The improvement according to claim 1 wherein the overlapping panels between said closed end and the registry of said second and third tightly knitted areas includes means defining face openings therein, whereby said cap is adapted to extend over the face of a wearer and the registry of said second and third tightly knitted areas is adapted to be located beneath the chin of the wearer.

5. The method of constructing a knit cap comprising the steps of, continuously knitting an elongated tubular member, periodically knitting a gathered, tighter stitched area at spaced intervals along the length of said continuous tubular member, a first of such gathered areas being knit in an area equal distance between the ends of said tubular piece, second and third gathered areas being knit in an area generally equally located between one of the open ends of said tubular piece and said first area, said second and third areas being knit generally equally located between said first area and said first open end and being relatively spaced from each other, fourth and fifth gathered areas being knit in an area between said first area and the second open end of said continuous piece and on the opposite side of said first area from said second and third areas, said fourth and fifth areas being knit generally equally located between said first area and said second open end and said fourth and fifth areas being relatively spaced from each other, folding said continuous tubular member on itself with said first area as a fold line, and bringing said second and third gathered areas into overlapping registry with respective ones of said fourth and fifth gathered areas, making a second fold in said continuous piece by folding the already folded piece on itself using a point equally located between said second and third and fourth and fifth gathered areas as the second fold line and bringing said second, third, fourth and fifth areas into overlapping registry, bringing the central area into registry with the original open ends of said tubular piece, and stitching said original open ends and said first gathered area together to close one end of said twice-folded tubular member.

* * * * *